United States Patent [19]

Leifeld

[11] 4,297,767

[45] Nov. 3, 1981

[54] APPARATUS FOR OPENING TEXTILE FIBER BALES

[75] Inventor: Ferdinand Leifeld, Kempen, Fed. Rep. of Germany

[73] Assignee: Trützschler GmbH & Co. KG, Monchen-Gladbach, Fed. Rep. of Germany

[21] Appl. No.: 88,573

[22] Filed: Oct. 26, 1979

[30] Foreign Application Priority Data

Nov. 2, 1978 [DE] Fed. Rep. of Germany ..... 2847461

[51] Int. Cl.[3] ..... D01C 7/04; D01C 7/06

[52] U.S. Cl. ..... 19/80 R; 19/145.5

[58] Field of Search ..... 19/80 R, 145.5, 81

[56] References Cited

U.S. PATENT DOCUMENTS

| | | | |
|---|---|---|---|
| 3,170,196 | 2/1965 | Denis | 19/80 R |
| 3,531,831 | 10/1970 | Van Doorn et al. | 19/81 |
| 3,663,993 | 5/1972 | Roberson | 19/80 R |
| 3,686,714 | 8/1972 | Wirth | 19/80 R |
| 3,736,624 | 6/1973 | Alt et al. | 19/80 R |
| 4,000,541 | 1/1977 | Marzoli | 19/145.5 X |

*Primary Examiner*—Louis Rimrodt
*Attorney, Agent, or Firm*—Spencer & Kaye

[57] ABSTRACT

An apparatus for opening textile fiber bales includes a bale opening arrangement adapted to travel parallel to the length of the apparatus along serially arranged fiber bales. The bale opening arrangement comprises a bale opening member having a plurality of opening elements for penetrating, in an opening zone, into the fiber material of the bales at an upper face thereof and a grate formed of parallel-spaced grate bars for engaging, in an operative position of the grate, the upper face of the bales. The opening elements of the opening member project in between adjoining grate bars in the opening zone. The grate bars, when viewed in their operative position, terminate in a free end in the opening zone.

22 Claims, 4 Drawing Figures

APPARATUS FOR OPENING TEXTILE FIBER BALES

BACKGROUND OF THE INVENTION

This invention relates to an apparatus for opening a plurality of textile fiber bales and is of the type which has an opening device including, for example, spiked rollers or toothed discs which are mounted on a carriage traveling horizontally back and forth parallel to the length dimension of the apparatus. The apparatus further comprises a grate through which the opening elements such as teeth or spikes project and which is adapted to directly engage a top face of the bale.

In a known apparatus of the above type the fiber bales are arranged in a stationary bale frame and there are provided vertically adjustable rails supporting a horizontally traveling carriage on which, in turn, a tuft removing arrangement (opening device) is mounted. This arrangement comprises a housing, a grate, an opening roller and a suction tube. The housing is secured to the carriage and, at its part oriented towards the bales, carries the grate through which project the spikes of the opening roller mounted in the housing. Further, on the housing there is mounted the suction nipple through which the fiber tufts are drawn away pneumatically into a flexible suction conduit. The grate extends over the entire bale surface underneath the opening roller and is fixedly attached at both ends of the housing to the underside thereof. In this manner the grate forms a closed space with the housing. The fiber tufts which are removed by the opening roller are thrown against one portion of the grate, approximately at the mid zone thereof. This known grate thus impedes a removal of the fiber tufts from the upper surface of the bale, significantly affecting the efficiency of the apparatus.

SUMMARY OF THE INVENTION

It is an object of the invention to provide an improved apparatus of the above-outlined type from which the discussed disadvantage is eliminated.

The invention is based on the recognition to shape the grate bars in such a manner that, on the one hand, they press down the upper layer of the fiber bale to prevent any fiber chunks from being torn out of the bale and, on the other hand, they ensure that a removal of the fiber tufts from the bale and its further transport are not impeded.

The above object and others to become apparent as the specification progresses, are accomplished by the invention, according to which, briefly stated, the grate is open at that side towards which the fiber tufts are thrown during the opening process. Stated differently, the bars of the operative grate terminate, with free ends, in the working zone (opening zone) of the opening member and thus an obstruction-free housing portion is provided ensuring unimpeded flight of the tufts toward and into the suction nipple.

Thus, according to the invention, the grate extends only approximately to the zone of the engagement of the opening elements (such as spikes or teeth) with the upper face of the bale. The fiber material is, by the longer portion of this shortened grate, pressed down prior to and, in essence, during the engagement by the opening elements. Adjacent the shortened portion of the grate there is provided a free space from which the fiber tufts may be readily drawn away in free flight. In this simple manner a higher output rate of the apparatus is ensured.

According to a further feature of the invention, the grate bars are secured at that end which is remote from the location of fiber opening. Expediently, the grates are pivotally or rotatably secured.

According to a preferred embodiment of the invention, alternating grate bars form two grate bar groups which are separately movable. Thus, adjoining grate bars can be pivoted or rotated independently from one another. In this manner ridges which form in the bale during the opening operation beween the grate and the bale surface can be ablated without difficulty.

According to another preferred embodiment of the invention, two oppositely oriented grates are provided at each side of the opening member. Each grate is formed of a plurality of grate rods. In this arrangement, during the forward and return passes, alternatingly one grate is in engagement with the bale face while the other grate is in an inoperative position. Expediently, the bars of the facing grates extend in a staggered manner in the paths of the opening device. Advantageously, the pressing force of the bars on the fiber bales is adjustable.

According to a further feature of the invention, an adjustable stop is provided for varying the height of the grate bars.

The grate has, among others, the function to press down on the upper face of the fiber bales for preventing any fiber lump from being torn out of the bale. Such a pressing effect is, however, in practice often insufficient to prevent the bales from tipping over which may be cased by the opening device as it works into the bale. Thus, according to a further feature of the invention, at either side of the opening member (that is, upstream and downstream thereof) there are provided axially parallel-arranged pressure rollers which press down on the upper face of the fiber bales. In this manner the pressing effect of the grate is increased. Expediently, the pressing rollers have toothed rings about their surface. Further, the pressure rollers are preferably driven by the drive which propels the carriage. It is particularly advantageous to rotate the opening member and the pressure rollers in the same direction.

DESCRIPTION OF THE PREFERRED EMBODIMENTS

Figure 1:
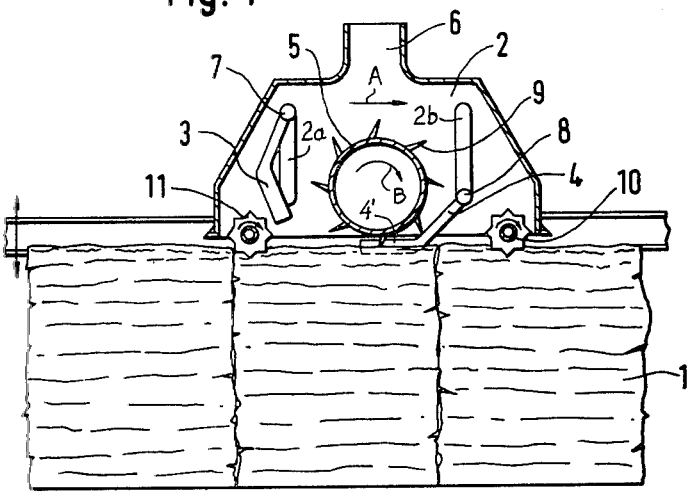
FIGS. 1 and 2 are schematic side elevational and top plan views, respectively, of a preferred embodiment of the invention.
Figure 2:
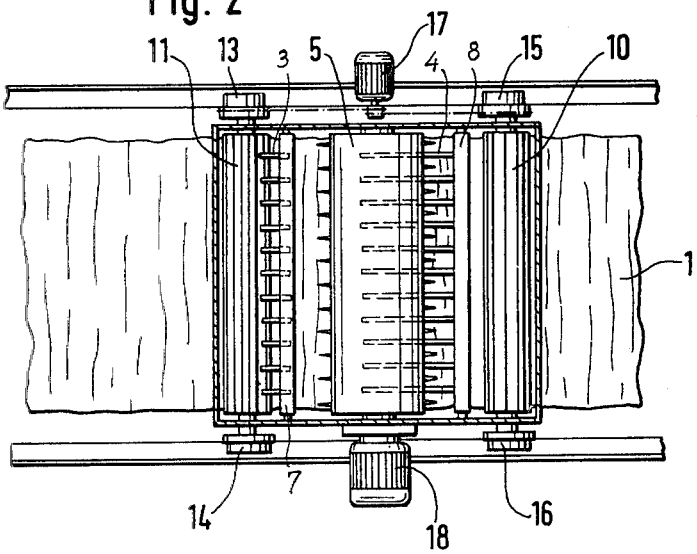

Turning now to FIGS. 1 and 2, the fiber bales 1 are positioned in a stationary bale frame (not shown in detail). On vertically adjustable horizontally extending rails there is mounted a carriage which may travel back an forth and on which there is mounted a tuft-removing (fiber bale opening) arrangement. The latter includes a housing 2, two grates 3 and 4, a spiked opening roller 5 and a suction outlet nipple 6. The grates 3 and 4 comprise respective transverse rods 7 and 8 to which the grate bars are affixed at one of their ends. The grate bars are unsupported (free) at their other ends. The transverse rods 7 and 8 are mounted for vertical reciprocation and rotation in vertical slots 2*a* and 2*b* provided in the housing 2.

According to FIG. 1, the bale opening arrangement travels in the direction of the arrow A and the opening member 5 rotates in the direction of the arrow B. During such a displacement the grate 3 is in an inoperative position, while the grate 4 is so arranged that, with its free end portion 4*a*, it projects into the rows between the spikes 9 of the opening roller 5, as shown in FIG. 2. Thus, the end portion 4' of the grate 4 lies on the upper face of the fiber bale 1. The terminus of the bars of the grate 4 is located in the zone of engagement of the spikes 9 with the upper face of the fiber bale 1. The grate 4, by means of its part 4' lying on the fiber bale serves as a hold-down device. By providing that the grate 4 terminates in the above-noted zone, a free, open space is formed in that portion of the housing 2 towards which the fiber tufts are thrown during the opening operation.

It is a particular advantage of the grates 3 aand 4 that the fiber material is held down particularly at the edges of the bales 1. This is of particular significance when the bales have unlike heights.

On either side of the axis of the opening roller 5, that is, both upstream and downstream thereof, there are provided two pressure rollers 10 and 11 which press on the upper face of the fiber bale. The pressure rollers 10 and 11 have toothed rings about their circumference. The spiked roller 5 and the pressure rollers 10 and 11 are rotated in the same direction; thus, for example, if the arrangement is traveling towards the right as viewed in FIG. 1, then the rollers 5, 10 and 11 rotate clockwise. As seen in FIG. 2, the ends of the rollers 11 and 10 are provided with pairs of wheels 13, 14 and 15, 16, respectively. A motor 17 drives the wheels 13 and 15; thus, the pressing rollers 10 and 11 are simultaneously driven. The opening roller 5 is driven by a motor 18.

When the traveling direction of the bale opening arrangement is reversed, that is, the carriage is propelled leftward as viewed in FIGS. 1 and 2, the direction of rotation of the opening roller 5 and the pressure rollers 10, 11 is reversed to rotate counterclockwise. At the same time, the grate 3 is caused to slide downwardly in the slot 2*a* and to rotate counterclockwise about the axis of the rod 7 to assume an operative, bale-pressing position. Simultaneously, the grate 4 is raised from its operative position along the slot 2*b* and is turned counterclockwise about the axis of the rod 8 to assume an inoperative, withdrawn position. Since now the opening roller 5 is rotated counterclockwise, the removed tufts are thrown towards the right into the housing portion which is now unobstructed due to the withdrawn position of the grate 4.

Figure 3A:
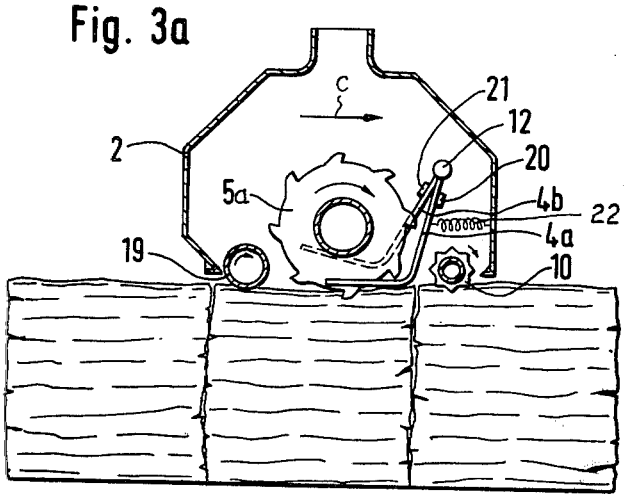
FIGS. 3*a* and 3*b* are schematic side elevational views of another preferred embodiment of the invention illustrating the apparatus in different operational positions.
Figure 3B:
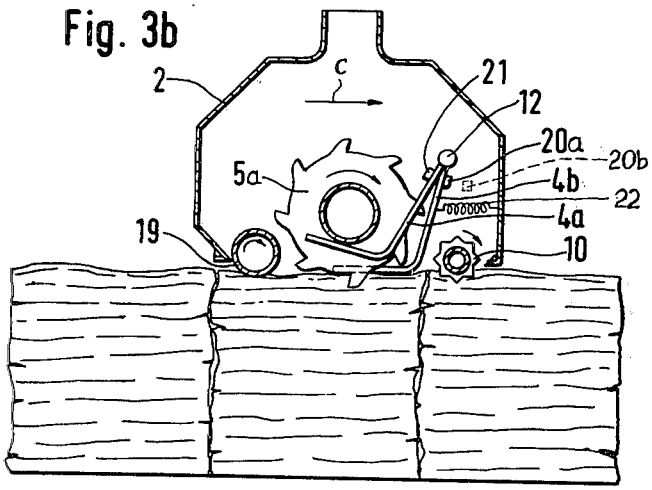

Turning now to the embodiments illustrated in FIGS. 3*a* and 3*b*, the adjoining rods 4*a* and 4*b* of the grate 4 are rotatable independently from one another about a rotary support 12. Expediently, the bars 4*a* form a first grate, while the bars 4*b*, which alternate with the bars 4*a*, form a second grate. In the embodiment illustrated, the grate rods are arranged only at one side of the opening roller 5*a* which, in this case, is formed of toothed discs (only one is visible in the Figures). Thus, in this arrangement, fiber removal occurs only when the carriage travels towards the right as indicated by the arrow C. In a first pass according to FIG. 3*a* the grate bars 4*a* lie on the bale surface while the grate bars 4*b* are withdrawn into an inoperative position. As this pass terminates at the longitudinal end of the bale frame, the opening arrangement is lifted and is propelled to execute an idle return travel. Thereafter, the arrangement is again lowered onto the bale surface to execute a new opening pass during travel towards the right. At the beginning of the second forward (rightward) pass, according to FIG. 3*b*, the grate bars 4*b* engage the upper face of the bale, whereas the grate bars 4*a* are moved into an inoperative position. In this manner ridges which were formed during the first forward pass because of a contact between the grate bars and the upper surface of the bale are exposed and can be ablated readily during the successive opening pass. FIGS. 3*a* and 3*b* further show adjustable stops 20 and 21 by means of which the position of the grate bars 4*a* and 4*b* may be set.

Such an adjustability for the stop 20 is shown in FIG. 3*b*. As seen, this stop may be shifted, for example, from its solid-line position 20*a* to its phantom-line position 20*b*. When the stop 20 is in the position 20*b*, the working position of the momentarily effective grate bars 4*a* and 4*b* is lower than if the stop 20 is in the position 20*a*. This means that the depth of penetration of the teeth of the opening member 5*a* will be less. Thus, by shifting the stop 20, the depth of penetration may be varied, for example, for different types of fiber material.

As further illustrated in FIG. 3*a*, there is provided a tension spring 22 attached to the housing 2 and the grate bars 4*a*. In this manner the effective portion of the grate bars is urged continuously against the upper face of the bale even if the latter is uneven. Thus, the spring 22 sets the pressing force of the grates on the bale. Dependent upon the particular fiber material, springs of different spring force may be used. It is to be understood that the same spring arrangement may be present for the grate bars 4*b*, as shown in FIG. 3*b*.

Downstream of the opening roller 5*a* (as viewed in the traveling direction C) there is provided a toothed pressing roller 10 which is axially parallel with the rotary axis of the opening roller 5 and which presses on the upper face of the fiber bales 1. On the upstream side of the opening roller 5*a* a smooth-surfaced pressing roller 19 is arranged. The housing 2 is laterially secured, with an end face, to a displaceable stand (not shown) by means of which the housing 2 can be adjusted vertically.

It will be understood that the above description of the present invention is susceptible to various modifications, changes and adaptations, and the same are intended to be comprehended within the meaning and range of equivalents of the appended claims.

What is claimed is:

1. In an apparatus for opening textile fiber bales, including a bale opening arrangement adapted to travel parallel to the length of the apparatus along serially arranged fiber bales; the bale opening arrangement including a bale opening member having a plurality of opening elements for penetrating, in an opening zone, into the fiber material of the bales at an upper face thereof and a grate means formed of parallel-spaced grate bars for engaging, in an operative position of the grate means, the upper face of the bales; the opening elements of the opening member projecting in between adjoining grate bars in the opening zone; the improvement wherein said grate bars, when viewed in said operative position, terminate in a free end in said opening zone.

2. An apparatus as defined in claim 1, further comprising means for setting the downward pressing force with which said grate bars engage the upper surface of the bales.

3. An apparatus as defined in claim 1, further comprising at least one adjustable stop for varying the height level of said grate bars.

4. An apparatus as defined in claim 1, further comprising axially parallel pressure rollers arranged at both sides of said opening member and extending transversely to the length dimension of the apparatus; said pressure rollers being arranged for engaging and pressing down on the upper surface of the bales.

5. An apparatus as defined in claim 4, further comprising toothed rings arranged along the circumference of at least one of said pressure rollers.

6. An apparatus as defined in claim 4, further comprising a drive motor for propelling said bale opening arrangement and for rotating said pressure rollers.

7. An apparatus as defined in claim 4, wherein said opening member is rotatably supported; further comprising means for rotating said pressure rollers and said opening member in the same direction.

8. An apparatus as defined in claim 1, wherein each said grate bar has an additional end opposite said free end; said grate bars being supported at their respective additional ends.

9. An apparatus as defined in claim 8, wherein said grate bars are movably supported at said additional ends for displacement into and out of the operative position.

10. An apparatus as defined in claim 9, wherein said grate bars are rotatably supported at said additional ends.

11. An apparatus as defined in claim 9, wherein said grate bars are pivotally supported at said additional ends.

12. An apparatus as defined in claim 9, wherein said grate bars are movable into and out of said operative position and further wherein adjoining grate bars are movable with respect to one another.

13. An apparatus as defined in claim 9, wherein said grate means comprises oppositely oriented first and second grates disposed, respectively, on either side of said opening member and supported movably with respect to one another to selectively assume operative and inoperative positions.

14. An apparatus as defined in claim 13, wherein said grate bars of said first and second grates alternate as viewed in a direction transverse to the length of the apparatus, whereby the first and second grates engage, when in their respective operative position, the upper surface of the bales at staggered locations.

15. In an apparatus for opening textile fiber bales, including a bale opening arrangement adapted to travel parallel to the length of the apparatus along serially arranged fiber bales; the bale opening arrangement including a bale opening member having a plurality of opening elements for penetrating, in an opening zone, into the fiber material of the bales at an upper face thereof; the improvement comprising in combination:

(a) at least one pressure roller arranged adjacent said opening member and extending transversely to the length dimension of the apparatus; said pressure roller being arranged for engaging and pressing down on the upper surface of the bales; and (b) a grate means formed of parallel-spaced grate bars for engaging, in an operative position of the grate means, the upper face of the bales; the opening elements of the opening member projecting in between adjoining grate bars in the opening zone.

16. An apparatus as defined in claim 15, wherein said at least one pressure roller comprises axially parallel pressure rollers arranged at both sides of said opening member.

17. An apparatus as defined in claim 16, further comprising toothed rings arranged along the circumference of at least one of said pressure rollers.

18. An apparatus as defined in claim 16, further comprising a drive motor for propelling said bale opening arrangement and for rotating said pressure rollers.

19. An apparatus as defined in claim 16, wherein said opening member is rotatably supported; further comprising means for rotating said pressure rollers and said opening member in the same direction.

20. An apparatus as defined in claim 15, further comprising toothed rings arranged along the circumference of said pressure roller.

21. An apparatus as defined in claim 15, further comprising a drive motor for propelling said bale opening arrangement and for rotating said pressure roller.

22. An apparatus as defined in claim 15, wherein said opening member is rotatably supported; further comprising means for rotating said pressure roller and said opening member in the same direction.

* * * * *